United States Patent [19]

Sommer

[11] 4,304,022

[45] Dec. 8, 1981

[54] UNDERWATER CLEANING APPARATUS

[75] Inventor: Peter Sommer, Schinznach-Dorf, Switzerland

[73] Assignee: Schenk AG, Switzerland

[21] Appl. No.: 106,834

[22] Filed: Dec. 26, 1979

[30] Foreign Application Priority Data

Dec. 27, 1978 [CH] Switzerland ..... 13183/78

[51] Int. Cl.[3] ..... E04H 3/20

[52] U.S. Cl. ..... 15/1.7; 15/415 A

[58] Field of Search ..... 15/1.7, 340, 418, 420, 15/415 A; 210/169

[56] References Cited

U.S. PATENT DOCUMENTS 3,337,889 8/1967 West ..... 15/1.7
3,868,739 3/1975 Hargrave ..... 15/1.7
3,950,809 4/1976 Schatzmann ..... 15/1.7
3,979,788 9/1976 Strausak ..... 15/1.7
4,154,680 5/1979 Sommer ..... 15/1.7 X

*Primary Examiner*—Edward L. Roberts
*Attorney, Agent, or Firm*—Roylance, Abrams, Berdo & Farley

[57] ABSTRACT

A tapering flow duct is formed below a chassis having a caterpillar track and forms lateral openings between a cleaning brush and the tracks. The flow duct is connected through an opening to a suction duct of a suction pump which conveys the sucked up liquids with the contaminants contained therein into a filter. Due to the increased flow velocity, the static pressure in the flow duct is reduced, so that the chassis is pressed onto the bottom surface and can overcome severe gradients without sliding.

8 Claims, 3 Drawing Figures

FIG. 2
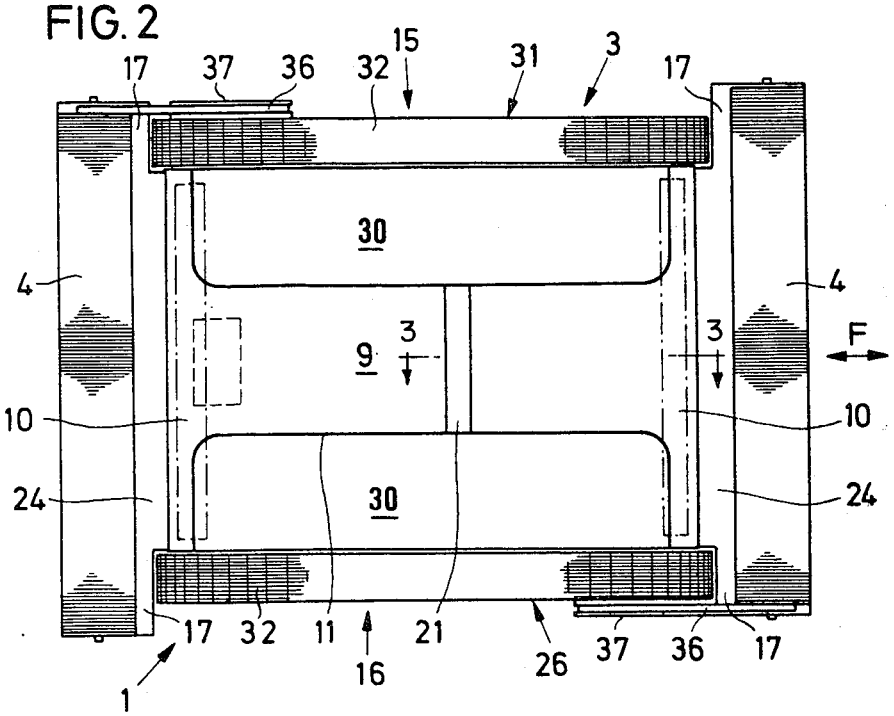
FIG. 1
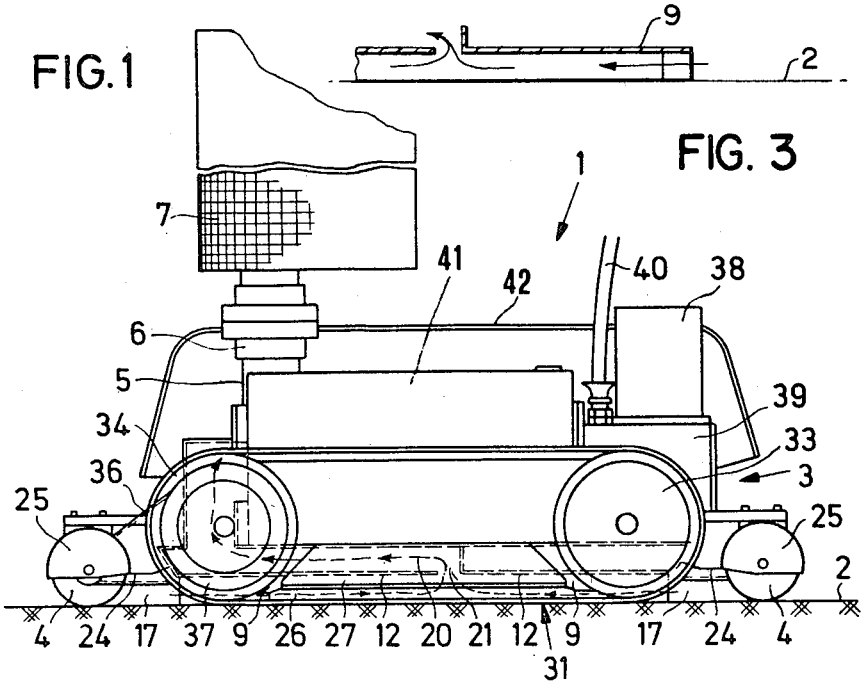
FIG. 3

UNDERWATER CLEANING APPARATUS

The invention relates to an apparatus for the underwater cleaning of a bottom surface or floor and particularly to a swimming pool cleaner in which a chassis moved on the bottom carries a cleaning brush and a suction pump for the suction of contaminants, the sucked up liquid being conveyed through a filter for collecting the contaminants.

BACKGROUND OF THE INVENTION

Cleaning apparatuses for underwater cleaning of a bottom surface, for example of a swimming pool, are known. Essentially, they have a suction pump arranged on a chassis which can be moved to and fro, the suction pump permitting the sucking up of contaminants which have been deposited on the bottom of the pool. In a known construction of such a device (U.S. Pat. No. 4,154,680) a suction nozzle terminating in a suction slot which takes up the entire width of the cleaning apparatus is positioned on a chassis moved by caterpillar tracks. The suction nozzle tapers to an intake connection, which is connected to the suction pump intake. A cleaning brush is arranged on the end face of the suction slot of the suction nozzle and through it flows the liquid sucked up by the suction pump.

The suction nozzle arranged on the chassis leads to a significant increase in the overall constructional length of the cleaning apparatus. Furthermore, when the apparatus is immersed, the load is removed from the caterpillar tracks due to buoyancy, so that despite the relatively high weight of the cleaning apparatus it can slide on sloping floor portions.

BRIEF SUMMARY OF THE INVENTION

An object of the present invention is to provide an apparatus for underwater cleaning of the type described wherein the constructional length and consequently the cost of construction thereof can be reduced and, simultaneously, the caterpillar truck can be constructed in such a way that it is less likely to slide, without additional means being necessary.

According to the invention, this problem is solved in that walls are provided on the underside of the chassis and together with the cleaning brush form a flow duct with a tapering duct portion over the bottom surface to which the suction pump is connected.

Briefly described, the invention includes an apparatus for cleaning a surface underwater, and particularly the bottom of a swimming pool comprising the combination of a chassis, means for moving the chassis across the surface to be cleaned, a cleaning brush carried by said chassis at an end thereof for contacting the surface to be cleaned, a filter and a suction pump carried by said chassis for causing flow of water and contaminants through said filter, wall means carried by said chassis on the bottom thereof for defining a flow duct for conveying water and contaminants from said brush to the inlet of said pump, said wall means extending along the surface to be cleaned and converging to form a tapered duct portion along said surface.

As a result, no additional constructional length is required for the suction device and by reducing the static pressure below the chassis an additional pressure is exerted on the truck.

BRIEF DESCRIPTION OF THE DRAWINGS

The invention is described in greater detail hereinafter relative to a non-limitative embodiment and the attached drawings, wherein show:

FIG. 1 is a side elevation of a diagrammatically represented underwater cleaning apparatus; and FIG. 2 is a bottom plan view of the apparatus of FIG. 1.

FIG. 3 is a partial side elevation in section of flow duct 9.

DETAILED DESCRIPTION OF THE PREFERRED EMBODIMENTS

The apparatus shown in FIGS. 1 and 2 have a frame-like chassis 3, on which is installed a suction pump 5 on whose pressure (output) connection 6 is arranged a filter 7. Suction pump 5 sucks up liquid with the contaminants contained therein at two locations, one at each end of the chassis. Each location is bounded by a rotary cleaning brush 4. The connection between the suction connection of suction pump 5 and the locations bounded by the cleaning brushes 4 is provided by a suction duct 20 arranged in chassis 3, the bottom of which forms a top covering wall 12 for a flow duct 9, which connects the suction duct 20 to the location bounded by the cleaning brushes 4 by an elongated connecting opening 21 through wall 12 whose width is approximately the same as that of flow duct 9. Flow duct 9 has a tapering duct portion 10, of FIG. 2, and is bounded on one side by said walls 11, on the top by the covering wall 12 and on the ends and the other side by the cleaning brush 4 and the bottom surface 2, respectively. Chassis 3 is moved on bottom 2 by means of a caterpillar truck 31, which has on the sides parallel to the travel direction F of chassis 3 caterpillar bands or tracks 32 guided by means of caterpillar wheels 33, 34, whereof wheel 33, for example, is driven.

The cleaning brushes 4 are longitudinally spaced from the caterpillar wheels 33, so that lateral openings 17 are formed, permitting the formation of a flow at right angles to the travel direction F in duct portion 10. This transverse flow serves to suck up any contaminants located externally of cleaning brush 4.

The liquid sucked up over the width of cleaning brush 4 and at lateral openings 17, together with the contaminants, flows at a relatively high speed in flow duct 9, which only has a fraction of the width of apparatus 1. As a result, the static pressure in flow duct 9 is reduced and chassis 3 is pressed onto bottom 2 with an increased force. Consequently, the caterpillar truck and, more particularly, the caterpillar bands 30 are pressed more strongly onto bottom 2, so that sliding is substantially excluded, even when bottom surface portions over which the apparatus is traveling have a considerable gradient.

On the side remote from the bottom surface 2, the cleaning brushes 4 have a guard 25. Between guard 25 and the covering wall 12, is provided a covering strip 24, which seals off duct portion 10 at the top.

The side walls 11 are made from a non-metallic, elastic material, such as an elastomer and would be deformed by the vacuum formed in flow duct 9. Therefore, a band guide 26 for guiding the caterpillar bands 32 between the caterpillar wheels 33, 34 and a support 27 which carries the band guide 26 is provided on each side of the apparatus and are constructed as a lateral sealing means, so that approximately the same static pressure in the flow duct 9 occurs in the spaces 30, the inner limits of which are formed by lateral walls 11. Thus, there is an increase in the surface area in which there is a lower static pressure and consequently the apparatus 1 presses more strongly onto the bottom surface 2.

The cleaning brushes are advantageously driven by an encased drive formed by a toothed belt 36, driving taking place by means of a gear wheel 27 arranged on the caterpillar wheels 33, 34.

The caterpillar truck 31 is driven by a drive motor 38 by means of a gear arranged in a casing 39. The energy for drive motor 38 and the control of the caterpillar truck 31 is supplied by a line 40.

At least one diving cell can be arranged on chassis 3 and the operation thereof is described in detial in U.S. Pat. No. 4,154,680. Furthermore, the complete apparatus is covered by a dome 42 beyond which only the filter 7 projects.

The present apparatus 1 operates in a very simple manner. By the arrangement of two cleaning brushes 4 there is no need to turn the apparatus at the end of its travel. Due to the lower static pressure under the chassis 3, the apparatus can climb relatively steep floor gradients in operation.

The invention is not limited to the embodiments described and represented hereinbefore and various modifications can be made thereto without passing beyond the scope of the invention.

What is claimed is:

1. An apparatus for cleaning a surface underwater and particularly the bottom of a swimming pool comprising the combination of a chassis, means for moving the chassis across the surface to be cleaned, a rotatable cleaning brush carried by said chassis at an end thereof for contacting the surface to be cleaned;

a filter and a suction pump carried by said chassis for causing flow of water and contaminants through said filter;

wall means carried by said chassis on the bottom thereof for defining a flow duct for conveying water and contaminants from said brush to the inlet of said pump;

said wall means extending along the surface to be cleaned and converging toward each other in a plane generally parallel to a plane containing the surface to be cleaned to form a tapered duct portion along said surface.

2. An apparatus according to claim 1 wherein said chassis includes second wall means along the bottom sides thereof parallel with the direction of travel of said chassis, and wherein said brush and the inlet end of said flow duct are spaced apart to define openings for producing a transverse flow with respect to the flow duct axis and said second wall means.

3. An apparatus according to claim 1 and including a brush at each end thereof extending perpendicular to the direction of travel of said chassis, and wherein said flow duct includes two duct portions facing in opposite directions, each duct portion having an inlet end directed toward one of said brushes.

4. An apparatus according to claim 1, wherein said wall means forming said flow duct includes a generally horizontal covering wall and flow duct is connected to a suction duct connected to the pump inlet arranged over said covering wall, the connection therebetween comprising a connection opening extending across the width of said flow duct.

5. An apparatus according to claim 4, wherein said cleaning brush has a guard on the side remote from the bottom surface, said guard being connected to said covering wall.

6. An apparatus according to claim 1, wherein said means for moving includes a caterpillar truck for carrying the chassis, and wherein the sides of the chassis extending parallel to the direction of travel are covered by a band guidance means of said caterpillar truck.

7. An apparatus according to claim 1, wherein said means for moving the chassis includes a caterpillar truck, and wherein the cleaning brush is driven by an encased drive, including a toothed belt driven by the caterpillar truck.

8. An apparatus according to claim 6 and further comprising means defining a space on each lateral side of said flow duct, said means including said wall means carried by said chassis, said band guidance means of said caterpillar truck, and a generally horizontal covering wall.

* * * * *